United States Patent [19]

Huang

[11] Patent Number: 4,796,780

[45] Date of Patent: Jan. 10, 1989

[54] BOX FOR PINS AND STAPLES

[75] Inventor: Harrison Huang, Shenkang, Taiwan

[73] Assignee: Glory Formosa Co., Ltd., China

[21] Appl. No.: 145,569

[22] Filed: Jan. 19, 1988

[51] Int. Cl.[4] ..... B65D 83/00

[52] U.S. Cl. ..... 221/154; 221/212; 206/340; 206/818

[58] Field of Search ..... 221/212, 154; 206/340, 206/350, 818

[56] References Cited

U.S. PATENT DOCUMENTS

| | | | |
|---|---|---|---|
| 938,235 | 10/1909 | Hermann | 221/212 |
| 2,544,114 | 3/1951 | Steinberg | 221/212 |
| 3,982,631 | 9/1976 | Kunik et al. | 206/350 X |
| 4,058,209 | 11/1977 | Schmidt | 221/212 X |

FOREIGN PATENT DOCUMENTS

| | | | |
|---|---|---|---|
| 1409537 | 10/1975 | United Kingdom | 206/350 |

*Primary Examiner*—Charles A. Marmor
*Attorney, Agent, or Firm*—Darby & Darby

[57] ABSTRACT

A pin and staple box composed of an outer case with the opening for placing the pins and staples and an inner box to be placed within the outer case. The upper end of the inner box can be ejected outside the top of the outer case. At the middle portion of the front of the outer case, a horizontally extended plate is formed. There is a small gap between the edge of the plate and the ejecting front plate of the inner box so that the ejection of the inner box shall not be hampered, and a chute is formed for placement of the metal pins, staples and the like. Further, on the front plate of the inner box, a magnetic element is installed. Thus, when the front plate of the inner box ejects to let a portion be exposed outside of the top of the outer case, the pins, staples and the like will affix to the front plate automatically, and the user can easily take them.

4 Claims, 3 Drawing Sheets

BOX FOR PINS AND STAPLES

BACKGROUND OF THE INVENTION

Field of the Invention

This invention relates to a kind of pin and staple box in which staples, pins, tacks and the like can be placed, and it can also automatically provide these items in such a way as to facilitate their being taken for use.

Currently, staples, pins, tacks and the like are important office supplies to be used by clerks or students. This is done especially when they process documents. In the past, commonly used containers for staples, pins, tacks and the like were simple in structure, in particular packaging boxes for such items. This kind of box was very fragile as to material and structure, and it often happened that the pins and staples would fall out and scatter. If the container was large, users would spend much time searching for the pins or staples when the pins or staples were about to be exhausted. For that reason, a pin and staple case was developed in the form of a magnetic suction type as shown in FIG. 5. On the inner wall of the opening 501 of the container 500, a coil of magnetic iron 502 was installed. Hence, when the user wanted to take a pin or staple, he could shake the container upwardly and make some pins or staples to be absorbed by the magnetic iron 502 and gathered at the edge of the opening of the container to be provided for people to take them for use. But, such kind of magnetic suction case for pins and staples results in the pins and staples being arranged around the edge at random. This may have increased haphazard conduit of the office. Besides, when the magnetic suction case for pins and staples is shaken up, the pins and staples inside the case would often fall out of it.

SUMMARY OF THE INVENTION

In view of the above-mentioned defects which existed in the commonly available pin and staple case, the present invention provides a kind of magnetic suction type case for pins and staples which does not require shaking of the container upwardly, and the pins, staples and the like can appear on the outside of the case body for the people to take them. That is a main object of the present invention.

According to the present invention, pins, staples and the like can be stored and held inside the case body when they are not in use. It can maintain the integrality of the magnetic suction type case for these items so that the good appearance of the office is promoted. That is another object of the present invention.

A more complete understanding of these and other features and advantages of the present invention will become apparent from a careful consideration of the following detailed description of certain embodiments illustrated in the accompanying drawings.

BRIEF DESCRIPTION OF THE DRAWINGS

FIG. 5 is the perspective view of one example of the conventional magnetic suction type case for pins, staples and the like.

DESCRIPTION OF THE PREFERRED EMBODIMENTS

Figure 1:
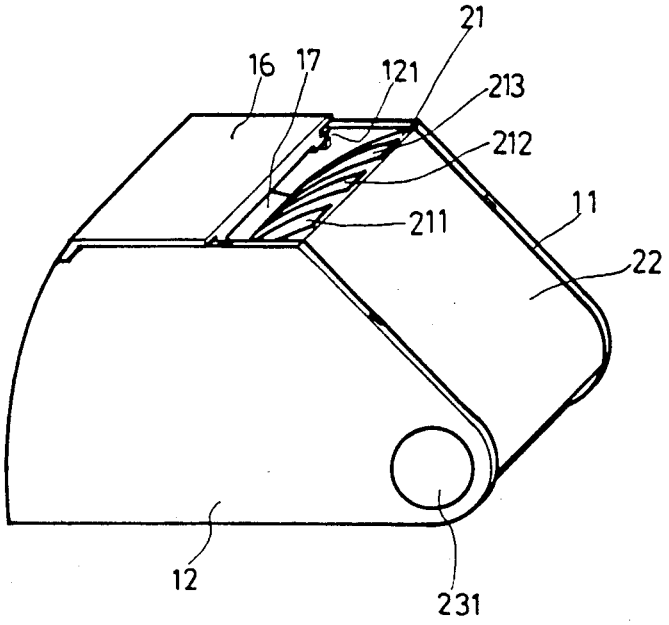
FIG. 1 is a perspective view of the preferred embodiment of this invention.
Figure 5:
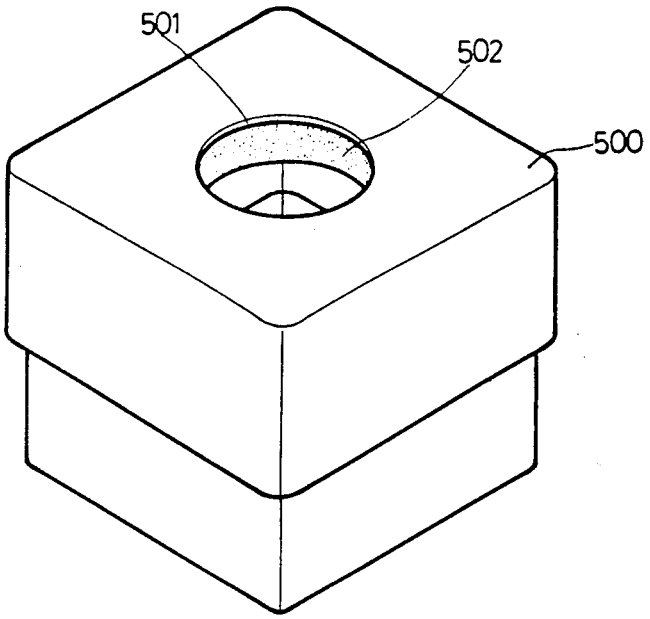
FIG. 5 PRIOR ART
Figure 2:
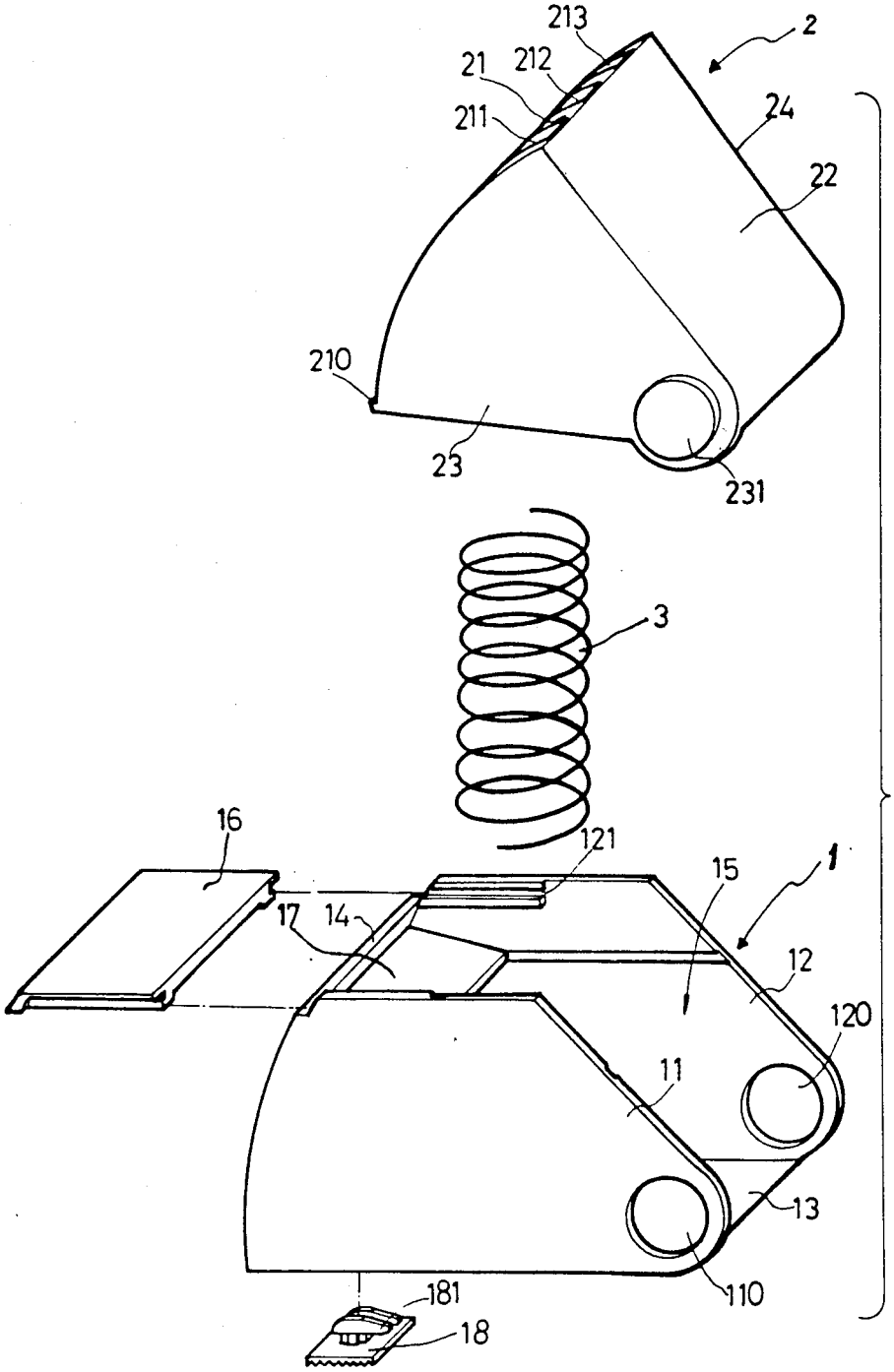
FIG. 2 is a perspective view of the separating parts of the present invention.
Figure 3:
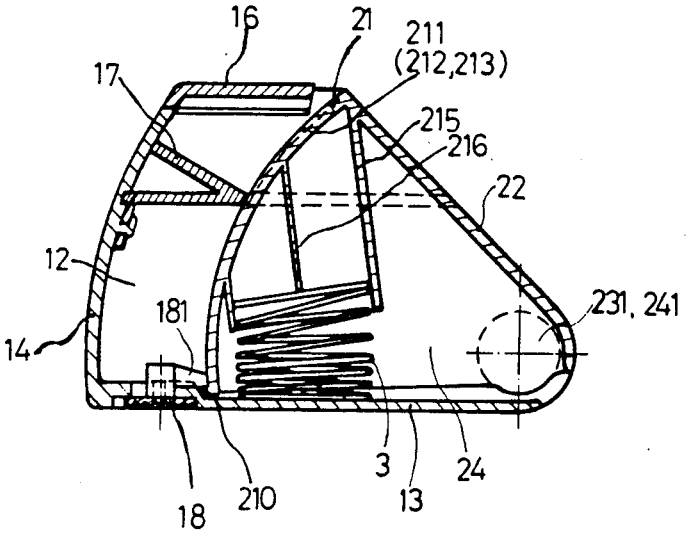
FIG. 3 is the longitudinal cross sectional view of the present invention.

Please refer to FIGS. 1, 2 and 3, in which the box for pins and staples in the present invention is composed of an outer case 1, a magnetic inner box to be placed within the outer case, and a spring 3 between the outer case 1 and inner box 2. Wherein, the outer case 1 has two side plates 11, 12, one bottom plate 13 and a front plate 14. The plates mentioned above close to form the case body. At its rear end an opening 15 is formed. At the rear lower corners of the two side plates 11, 12, are round holes 110, 120 respectively. On the tops of the two side plates 11, 12 there are sliding grooves 111, 121, respectively. The two side edges of a cover plate 16 enter the sliding grooves 111, 121, and are supported by the sliding grooves 111, 121, respectively. Thus, the cover plate 16 can be pulled out or pushed in. Of course, the cover plate can be formed in other structures, for example, the cover plate 16 can be made into a structure so as to be able to be turned over. In the middle portion of the inner side of the face front plate 14 of the outer case 1, there is an inclination plate 17 extending backward for some distance. The inner box 2 is a case body in the shape of upside down bottomless cover, which is made of a front plate 21, a top plate 22 and two side plates 23, 24. At the rear ends of the lower edges of the two side plates 23, 24, there are a pair of round-shaped protruding elements 231, 241 formed respectively on there surfaces. The protruding elements extend into the round holes 110, 120 of the two side plates 11, 12 of the outer case respectively to serve as rotation axis a of the inner box 2. The surface of the front plate 21 of the inner box has many sheets of magnetic iron 211, 212, 213. Besides, the bottom edge of the front plate 21 bends upward to form a hook edge 210. At the bottom of the upper part of the front plate 21, there is a cylinder 215 extending downward. In the cylinder 215, there is a guard plate 216. The spring 3 is placed in the cylinder to cause the spring's upper and lower ends to support against the bottom edge of the guard plate 216 and the upper surface of the bottom plate 13 of the outer case 1. On the outer case 1, there is a trigger button 18 which extends into the inner portion of the outer case 1 to form a hook 181. By means of the hook 181, the hook edge 210 bending upward on the bottom edge of the front plate 21 of the inner box 2 can be hooked up to maintain the inner box 2 to be contained inside the outer case 1.

As shown in FIG. 3, in assembly of this invention, firstly the round-shaped protruding elements 231, 241 at the rear edge of the bottom of the two side plates 23, 24 of the inner box 2 are placed respectively into the round holes 110, 120 on the two side plates 11, 12 of the outer case 1. Then the spring 3 is put into the round cylinder 215 at the bottom of the upper part of the front plates 21 of the inner box 2. Finally, the trigger button 18 on the outer case 1 hooks up with the hook edge 210 bending upward at the bottom edge of the front plate 21 in the inner box 2, so that the assembly is finished. There is only a very small gap between the edge of the inclination plate 17 extending backward from the inner face of the front plate of the outer case 1 and the surface of the front plate 21 of the inner box 2. Hence the activity of the inner box 2 will be not hampered. Besides, the front plate 21 of the inner box 2, the front plate 14, and the side plates 11, 12 of the outer case 1 form the space for holding and storing the pins, staples and the like.

Figure 4:
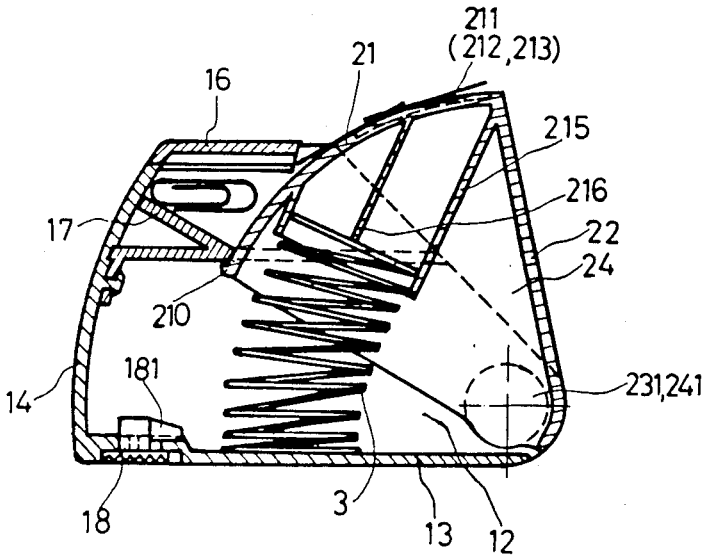
FIG. 4 is the longitudinal cross sectional view in the practical use of the present invention.

As shown in FIGS. 3 and 4, in using the present invention, the trigger button 18 at the outer case 1 is pushed to cause the front plate 21 of the inner box 2 to be unhooked from the hook sheet 181. Due to the function of the spring 3, the front plate 21 and the upper part of the top plate 22 of the inner box 2 eject open upward until the hook edge of the bottom of the front plate 21 is stopped by the inclination plate 17 on the inner side of the front plate 14 of the outer case. Thus the pins, staples and the like are absorbed by the magnetic plates 211, 212, 213 and affixed to the front plate 21 of the inner box 2 so as to be exposed outside of the outer case 1 to facilitate the immediate draw by a user. If the pins or staples are not in use, the inner box 2 is placed into the outer case 1 to cause the bottom edge of the front plate 21 of the inner box 2 to be hooked up. Then the staples, tacks and the like which are sucked and affixed to the front plate 21 of the inner box 2 again enter the outer case 1.

While the foregoing description and drawings represent the preferred embodiments of the present invention, it will be obvious to those skilled in the art that various changes and modifications may be made therein without departing from the true spirit and scope of the present invention.

I claim:

1. A box for pins, staples and the like comprises: an outer case having an opening and an inner box with an upper part projecting out of the top of the outer case; a spring; said outer case having two side plates, one bottom plate and a front plate; said two side plates having round holes disposed at rear lower corners thereof respectively; an inclination plate affixed to an inner side of said front plate, said inclination plate extending backward for a distance; a trigger button extending into the inner portion of the outer case formed in the shape of a hook; said inner box including a front plate with at least one magnetic iron element, a top plate and two side plates; on each of the two side plates of the inner box, a round protruding element enters the round holes on the two side plates of the outer case to serve as a rotating axis of the inner box; the bottom edge of the front plate of the inner box being bent upward to form a hook edge; a cylinder extending downwardly from a bottom edge of the top of the inner box, said spring having its top end inserted in said cylinder and its bottom end being supported against an upper surface of the bottom plate of the outer case, said trigger button for releasably hooking onto the hook edge of the front plate of the inner box.

2. A box for pins, staples and the like as claimed in claim 1, wherein a guard plate is included extending downwardly within said cylinder.

3. A box for pins, staples and the like as claimed in claim 1, wherein said magnetic iron element at the front plate of the inner box is installed so as not to be exposed on its surface.

4. A box for pins, staples and the like as claimed in claim 1 wherein there is a very small gap between the front plate of the inner box and any end face of the inclination plate on the inner side of the front plate of the outer case.

* * * * *